US008387321B2

(12) United States Patent
diGirolamo et al.

(10) Patent No.: US 8,387,321 B2
(45) Date of Patent: Mar. 5, 2013

(54) CONNECTOR FOR CONNECTING BUILDING COMPONENTS

(75) Inventors: Edward R. diGirolamo, Raleigh, NC (US); John Herrmann, Raleigh, NC (US); Nabil Abdel-Rahman, Raleigh, NC (US)

(73) Assignee: The Steel Network, Inc., Durham, NC (US)

( * ) Notice: Subject to any disclaimer, the term of this patent is extended or adjusted under 35 U.S.C. 154(b) by 472 days.

(21) Appl. No.: 12/468,499

(22) Filed: May 19, 2009

(65) Prior Publication Data

US 2010/0126103 A1 May 27, 2010

Related U.S. Application Data

(63) Continuation-in-part of application No. 10/095,411, filed on Mar. 12, 2002, now Pat. No. 7,533,508.

(51) Int. Cl.
*E04H 1/02* (2006.01)
*E04H 1/06* (2006.01)

(52) U.S. Cl. ..... 52/242; 52/241; 52/293.3; 52/293.5; 52/713

(58) Field of Classification Search ..... 52/293.3, 52/712, 714, 713, 715, 701, 295, 241, 242
See application file for complete search history.

(56) References Cited

U.S. PATENT DOCUMENTS

| | | | | |
|---|---|---|---|---|
| 491,091 | A | 2/1893 | Drake | |
| 625,427 | A * | 5/1899 | Stewart et al. | 403/190 |
| 659,350 | A * | 10/1900 | Osborn | 52/220.1 |
| 1,188,959 | A | 6/1916 | McAlarney | |
| 1,451,198 | A | 4/1923 | Benson | |
| 1,709,778 | A | 4/1929 | Crozier | |
| 2,138,291 | A * | 11/1938 | Callaghan | 52/290 |
| 2,256,394 | A * | 9/1941 | Lamel | 52/210 |
| 2,321,671 | A | 6/1943 | La Grotta | |
| 2,340,891 | A | 2/1944 | Manofsky | |
| 2,368,620 | A | 2/1945 | Strom | |
| 2,574,074 | A | 11/1951 | Vogel | |
| 2,610,710 | A | 9/1952 | Shannon | |
| 3,245,185 | A | 4/1966 | Rowe | |
| 3,833,198 | A | 9/1974 | Holzman | |
| 3,924,834 | A | 12/1975 | Young | |
| 4,013,253 | A | 3/1977 | Perrault et al. | |
| 4,261,593 | A | 4/1981 | Yeager | |
| 4,263,762 | A | 4/1981 | Reed | |
| 4,330,974 | A * | 5/1982 | Fleisch et al. | 52/489.1 |
| 4,373,304 | A | 2/1983 | Howitt | |

(Continued)

FOREIGN PATENT DOCUMENTS

| | | |
|---|---|---|
| GB | 2063329 | 6/1981 |
| GB | 2132073 | 7/1984 |

(Continued)

*Primary Examiner* — Phi Dieu Tran A
(74) *Attorney, Agent, or Firm* — Coats & Bennett, P.L.L.C.

(57) ABSTRACT

A connector for a wall structure wherein the connector connects to and reinforces a stud within the wall structure, or in some cases, the connector actually functions as a stud. The connector includes an elongated web and a pair of flanges that project from the web. About the lower portion of the connector there is provided a series of tabs that extend from the web and the two flanges and are turned so as to overlap and form a transfer structure that extends between the flanges about the lower end of the connector. In use, the connector can be connected to respective studs in a wall structure and at the same time anchor to an underlying structure such as a floor. In other cases, the connector itself can be utilized in the wall structure as a stud.

5 Claims, 11 Drawing Sheets

U.S. PATENT DOCUMENTS

| | | | | | |
|---|---|---|---|---|---|
| 4,382,488 | A | | 5/1983 | Anderson | |
| 4,575,979 | A | | 3/1986 | Mariani | |
| 4,691,491 | A | | 9/1987 | Lilley | |
| 4,796,403 | A | | 1/1989 | Fulton et al. | |
| 4,998,394 | A | | 3/1991 | Holzapfel et al. | |
| 5,042,615 | A | | 8/1991 | Anderson | |
| 5,092,097 | A | * | 3/1992 | Young | 52/702 |
| 5,218,803 | A | * | 6/1993 | Wright | 52/243 |
| 5,295,335 | A | | 3/1994 | Collier | |
| 5,317,850 | A | * | 6/1994 | Colonias et al. | 52/293.3 |
| 5,467,570 | A | * | 11/1995 | Leek | 52/712 |
| 5,519,977 | A | | 5/1996 | Callahan et al. | |
| 5,524,727 | A | | 6/1996 | Yennie, Jr. | |
| 5,664,392 | A | | 9/1997 | Mucha | |
| 5,794,395 | A | | 8/1998 | Reed | |
| 5,810,303 | A | | 9/1998 | Bourassa et al. | |
| 5,885,024 | A | | 3/1999 | Zupan et al. | |
| 5,979,130 | A | * | 11/1999 | Gregg et al. | 52/295 |
| 6,138,426 | A | * | 10/2000 | Mork et al. | 52/562 |
| 6,158,188 | A | * | 12/2000 | Shahnazarian | 52/702 |
| 6,250,041 | B1 | * | 6/2001 | Seccombe | 52/712 |
| 6,327,831 | B1 | | 12/2001 | Leek | |
| 6,389,778 | B1 | * | 5/2002 | Strange | 52/745.19 |
| 6,453,634 | B1 | * | 9/2002 | Pryor | 52/713 |
| 6,484,460 | B2 | | 11/2002 | VanHaitsma | |
| 6,513,290 | B2 | | 2/2003 | Leek | |
| 6,523,322 | B1 | * | 2/2003 | Michalski et al. | 52/745.05 |
| 6,625,945 | B2 | | 9/2003 | Commins | |
| 6,712,655 | B1 | | 3/2004 | Schlemmer et al. | |
| 7,014,383 | B2 | * | 3/2006 | Schmid et al. | 403/231 |
| 7,191,990 | B2 | | 3/2007 | Hutter, III | |
| 7,296,386 | B2 | | 11/2007 | Leek | |
| 2002/0020135 | A1 | | 2/2002 | Grove, Jr. et al. | |
| 2002/0020137 | A1 | | 2/2002 | Commins | |
| 2002/0121066 | A1 | | 9/2002 | Callahan et al. | |
| 2003/0009980 | A1 | | 1/2003 | Shahnazarian | |
| 2003/0213194 | A1 | * | 11/2003 | Kawai et al. | 52/272 |
| 2004/0050012 | A1 | | 3/2004 | Pulkkanen et al. | |
| 2006/0032180 | A1 | | 2/2006 | Peterson | |
| 2006/0260259 | A1 | | 11/2006 | Morse | |
| 2007/0028542 | A1 | * | 2/2007 | Lafferty et al. | 52/293.3 |
| 2007/0234662 | A1 | * | 10/2007 | Hanig et al. | 52/293.3 |
| 2009/0165409 | A1 | * | 7/2009 | McClain et al. | 52/293.3 |

FOREIGN PATENT DOCUMENTS

| | | |
|---|---|---|
| JP | 58204228 | 11/1983 |
| JP | 07057830 | 3/1995 |
| JP | 11256728 | 9/1999 |
| JP | 2001241113 | 9/2001 |

* cited by examiner

CONNECTOR FOR CONNECTING BUILDING COMPONENTS

CROSS REFERENCE TO RELATED APPLICATION

This is a continuation-in-part of U.S. patent application Ser. No. 10/095,411 filed on Mar. 12, 2002 entitled "Connector for Connecting Building Components". The disclosure of this application is expressly incorporated herein in its entirety and referred to herein as the "incorporated application".

FIELD OF THE INVENTION

The present invention relates to metal connectors and more particularly to a connector for connecting a metal building stud to an underlying or overlying support structure.

BACKGROUND OF THE INVENTION

In recent years, cold-formed steel framing for both residential and commercial applications has grown at a tremendous rate. Today, engineers, architects and contractors appreciate that light steel framing is a better value than more traditional materials such as masonry or wood.

Light steel framing is ideal for floors, roofs, support structures for finishes, non-load bearing walls, and even load-bearing walls up to approximately nine stories. With wall systems, whether they are load-bearing or non load-bearing, it is customary to use connectors or clips to secure individual metal studs to overlying and/or underlying support structures. Various connector or clip designs are known. For example, it is known to use simple L-shaped connector designs to interconnect metal studs with an underlying or overlying floor structure, for example. However, typical L-shaped connectors may not necessarily handle the variety of loads and forces that are sometimes experienced where studs are joined or secured to a floor or other support structure. More particularly, conventional connector designs may not always efficiently and effectively resist uplift, horizontal and rotational loads that are experienced about connecting points between such studs and an adjacent support structure.

Therefore, there has been and continues to be a need for a more heavy duty and durable connector for connecting metal studs to floors and other adjacent support structures that will effectively resist uplift, horizontal and rotational loads.

SUMMARY OF THE INVENTION

The present invention relates to a connector for use in a wall structure. In one mode, the connector is designed to be anchored or secured to an underlying support structure and to a stud that forms a part of the wall structure. In another mode, the connector itself can function as a stud in a wall structure.

The connector, in the present invention, includes a web and a pair of flanges. Formed about the lower end of the connector is a plurality of tabs that includes one or more openings that permit one or more fasteners to be extended therethrough for anchoring the connector to an underlying support structure. In use, a series of fasteners is extended through the web of the connector for connecting to the web of an adjacent stud.

Furthermore, the connector of the present invention can be utilized as a stud itself. This mode of use is particularly appropriate when the wall structure is a partial or half-wall.

In one exemplary embodiment, the connector is provided with a reinforcing member such as a plate or a reinforcing channel that is disposed over the one or more tabs formed in a bottom portion of the connector. In either case, one or more fasteners extends through the reinforcing member and on through one or more underlying tabs to where the one or more fasteners are anchored into the underlying support structure. This securely anchors the connector to the underlying support structure.

Other objects and advantages of the present invention will become apparent and obvious from a study of the following description and the accompanying drawings which are merely illustrative of such invention.

DESCRIPTION OF EXEMPLARY EMBODIMENTS

With further reference to the drawings, the connector of the present invention is shown therein and indicated generally by the numeral 10. As will be appreciated from subsequent portions of the disclosure, connector 10 is adapted to be used in a building construction assembly and while the connector 10 may be utilized in different ways, in one exemplary embodiment the connector 10 is utilized to fasten or connect metal building studs to an underlying or overlying support structure.

Figure 1A:
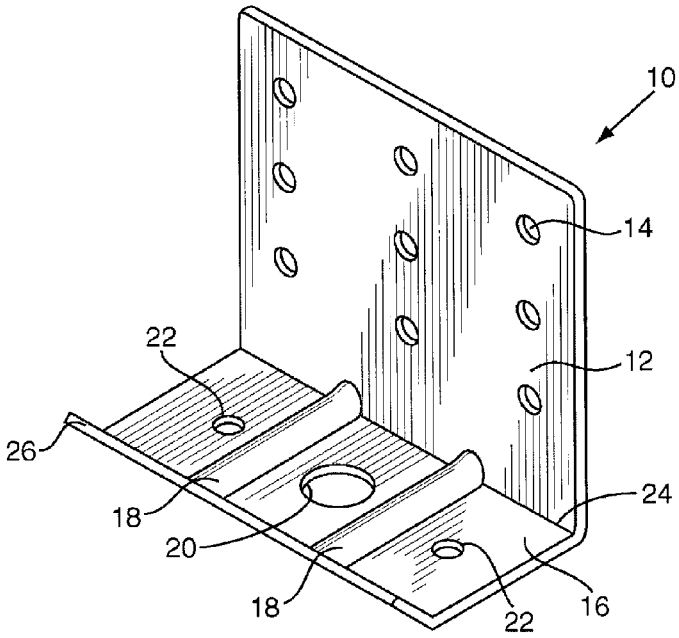
FIG. 1A is a perspective view of the connector of the present invention.
Figure 1B:
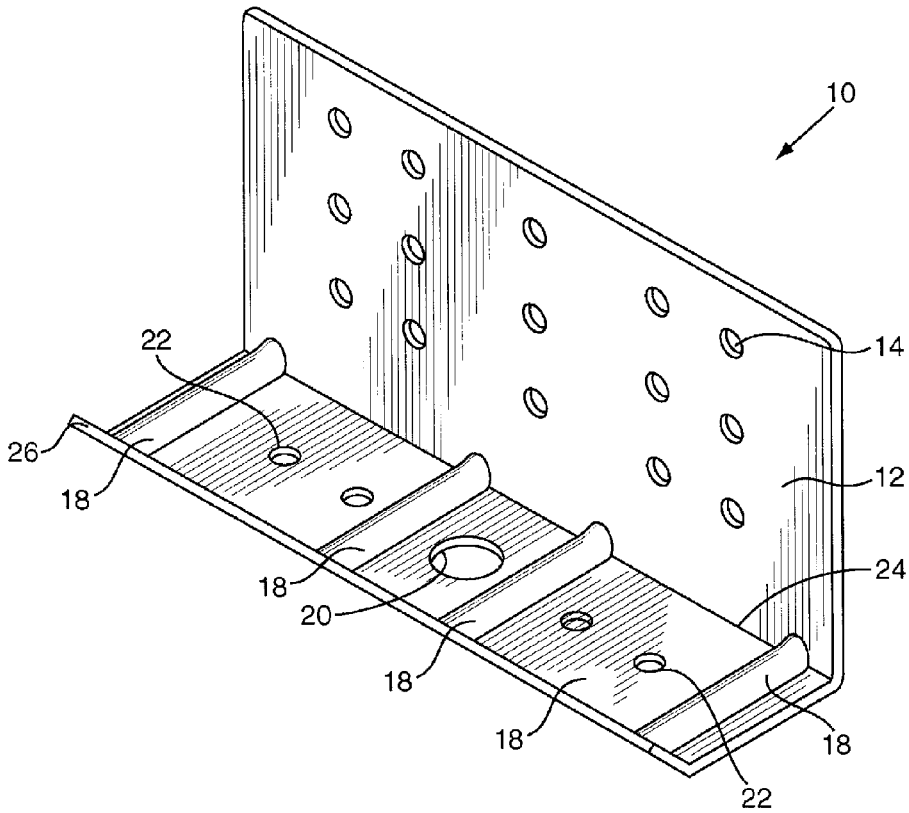
FIG. 1B is a perspective view of the connector of the present invention showing a somewhat wider embodiment that that shown in FIG. 1A.

Turning to a description of the connector 10, as seen in FIGS. 1A and 1B, the connector 10 includes a connecting plate 12. The connecting plate 12 includes a series of openings 14 that are designed to receive fasteners such as screws or bolts that act to secure the connector 10 to a vertical support member such as a building stud indicated generally by the numeral 50 in FIGS. 3 and 4.

Extending from the connecting plate 10 is a base plate 16. Base plate 16 includes a series of reinforcing ribs 18. The reinforcing ribs 18 extend generally perpendicular to a juncture or fold line indicated by the numeral 24. Further, base plate 16 includes one or more openings that enable fasteners to be extended downwardly through the base plate 16 so as to secure the entire connector 10 to an underlying structure such as a concrete floor, for example. In the case of the embodiments illustrated in FIGS. 1A and 1B, the openings formed in the base plate 16 include one central opening 18. In cases of both embodiments shown in FIGS. 1A and 1B, the central opening 20 is disposed generally centrally within the base plate 16 and between two ribs 18 that are disposed about a central area of the base plate 16. As will be appreciated from subsequent portions of the disclosure, central opening 20 is designed to enable a lag screw of substantial size to be extended downwardly through the opening for engagement with an underlying support structure. Such a lag screw, if used, will securely anchor the entire connector 10 to the underlying support structure. In addition, the base plate 16 includes one or more openings 22. Openings 22 in the case of the embodiments illustrated are somewhat smaller than the central opening 20. However, the size of all the openings can vary depending upon design and application. In any event, openings 22 are suitable for receiving other elongated fasteners such as screws or bolts that would be used also to secure and anchor the entire connector 10 to an underlying or overlying support structure such as a floor structure or beam.

Also comprising a part of connector 10 is an upturned flange 26. Note that upturned flange 26 extends from the base plate 16 opposite the juncture 24. The upturned flange can be formed by bending an edge portion of the base plate 16 upwardly. Alternatively, the upturned flange 26 can be a separate element or component and can be secured to the base plate 16 by weldment or suitable means.

Figure 2A:
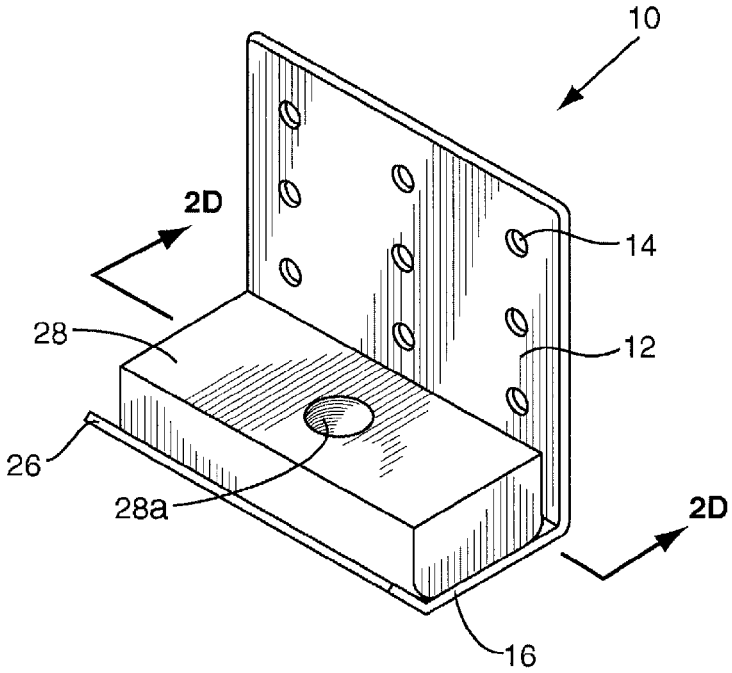
FIG. 2A is a perspective view of an alternate embodiment of the present invention.
Figure 2B:
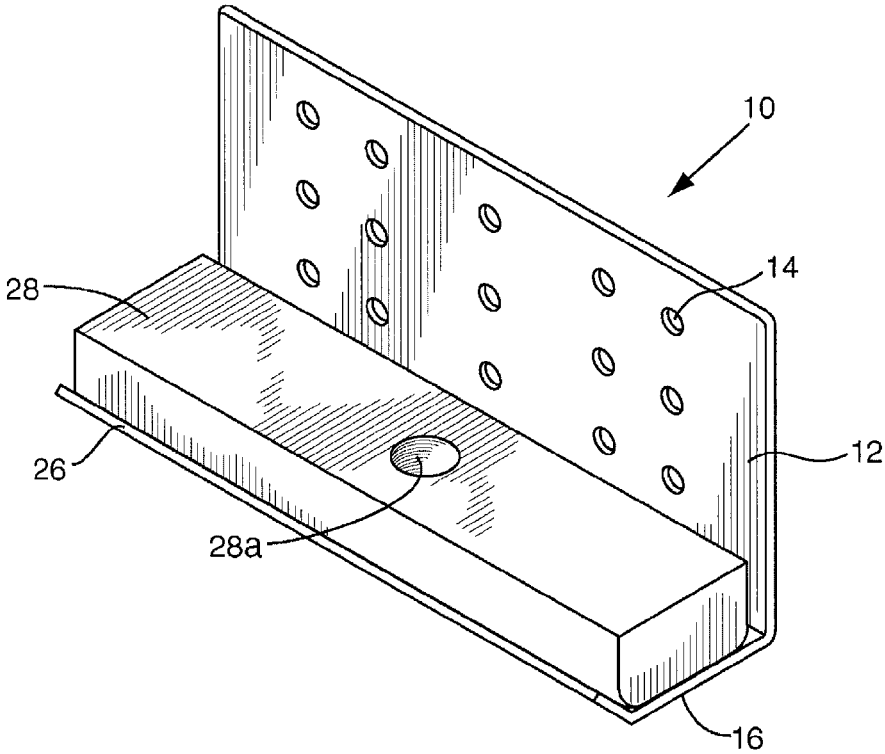
FIG. 2B is a perspective view of the connector of the present invention showing a somewhat wider embodiment than that shown in FIG. 2A.
Figure 2C:
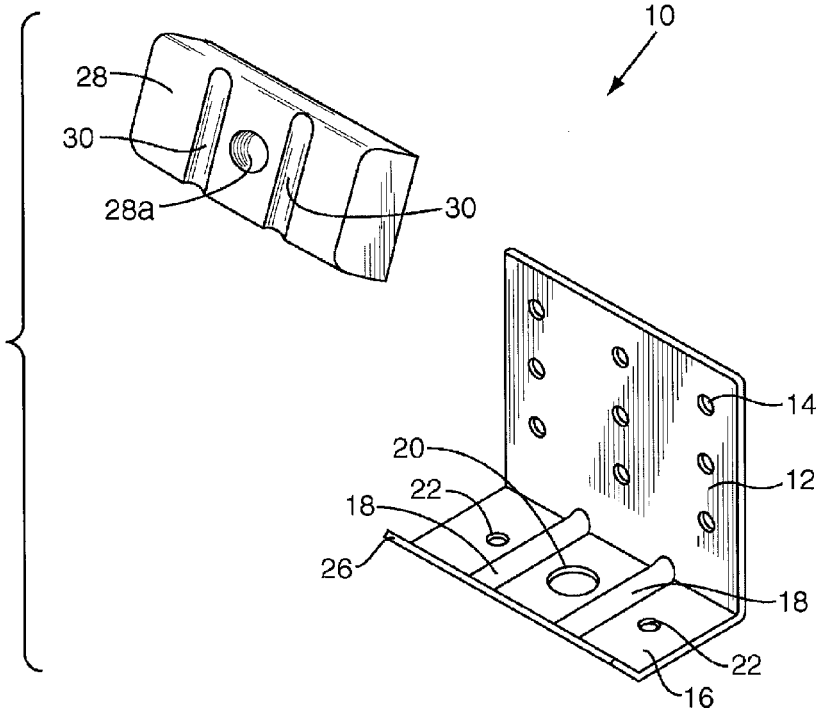
FIG. 2C is an exploded view of the connector showing the reinforcing member rotated so as to show the recesses formed on the bottom surface thereof.

Turning to FIGS. 2A and 2B, another embodiment of the connector 10 is shown therein. Basically the structure of the connector 10 as shown in FIGS. 2A and 2B conforms generally to the structure of the connector shown in FIGS. 1A and 1B. However, in the case of the embodiment illustrated in FIGS. 2A and 2B, there is provided, in addition to the structure already discussed, a reinforcing member or block 28. Reinforcing member or block 28 extends transversely over the top surface of the base plate 16. As shown in FIGS. 2A and 2B, when the connector includes an upturned flange 26, the reinforcing member 28 is generally confined or cradled between the upturned flange 26 and the connecting plate 12.

Formed centrally within the reinforcing member 26 is a central opening 28*a* that would align with the central opening 20 formed in the base plate 16. In addition, if additional fasteners are needed to secure the connector 10 to an underlying support structure, the reinforcing member 28 can be provided with additional openings that would align with other openings, such as openings 22, formed in the base plate 16.

About the underside of the reinforcing member 28, there may be provided a series of grooves or notches that are referred to as recesses 30. These recesses 30 are designed to receive and mate with the ribs 18 shown in FIGS. 1A and 1B. In the case of the embodiment shown in FIG. 2A, the underside of the reinforcing member 28 would be provided with two elongated recesses for receiving and mating with the two ribs 18 shown therein. Likewise, in the case of an embodiment such as shown in FIGS. 1A and 2B, the reinforcing member 28 would be provided with a series of four rib recesses 30.

Figure 2D:
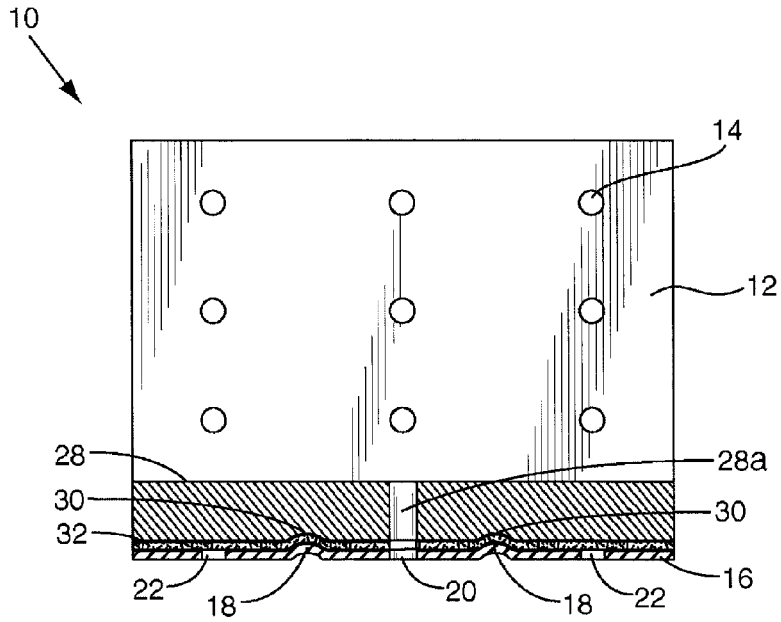
FIG. 2D is a cross-sectional view of the embodiment shown in FIGS. 2A and 2B taken through the line 2D-2D, and particularly illustrating that the reinforcing member could be secured to the base plate by an adhesive layer.

The reinforcing member of block 28 may in some embodiments be secured to the underlying base plate 16. For example, as indicated in FIG. 2D, the reinforcing member 28 is secured by an adhesive layer 32 to the underlying base plate 16.

In use, the connector 10 of the present invention may be used in various ways in building construction to secure one component to another component. In the way of an example, the connector 10 can be utilized to connect a stud, indicated generally by the numeral 50 in FIGS. 3 and 4 to an underlying or overlying support structure such as a floor, beam, etc. As shown in the drawings, the studs 50 are generally of the metal type and include a central web 52 flanked by a pair of flanges 54. Also, it is appreciated that in typical metal building construction that a U-shaped channel is often used as an interface between the studs 50 and an upper or lower support structure. In this regard, note in FIGS. 3 and 4 where there is provided an elongated channel indicated generally by the numeral 60 that receives opposed ends of the studs 50. Each channel 60 includes a central web 62 and a pair of flanges 64.

Figure 3:
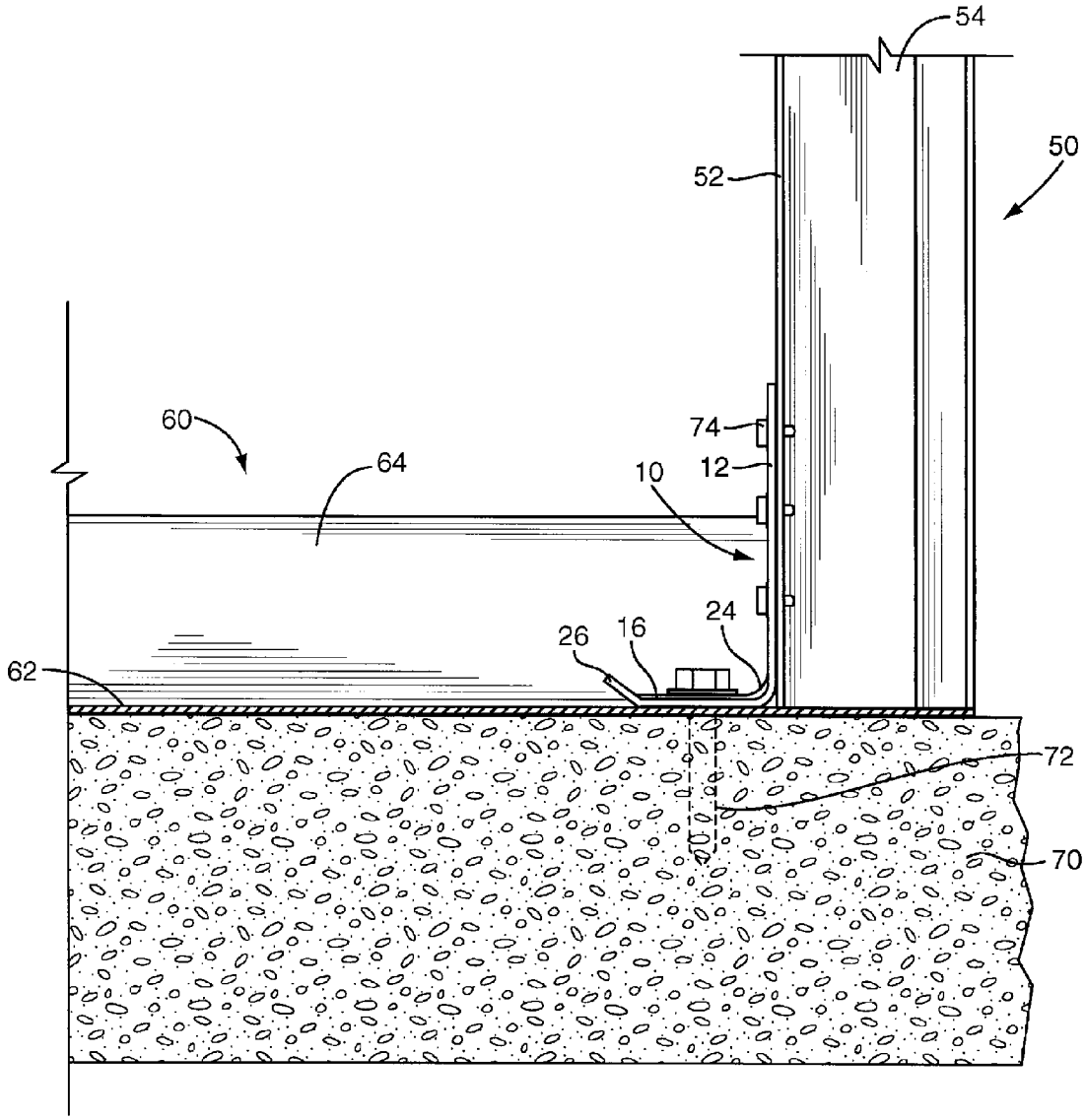
FIG. 3 is a fragmentary sectional view showing the connector of the present invention connecting a metal building stud to a lower channel and to an underlying concrete floor.

FIG. 3 shows in section the use of the connector 10 to connect a stud 50 to the channel 60. Note the provision of the underlying support structure 70 that supports the channel 60. In the embodiment illustrated in FIG. 3, a concrete floor section indicated by the numeral 70 underlies the channel 60 and supports both the channel 60 and the various studs 50 that extend upwardly from the channel 60. Also a lag screw 72 extends downwardly through the base plate 16 into the underlying concrete floor 70. Further, a series of screws or other fasteners 74 extend through the openings 14 formed in the connecting plate 12 and connect the connecting plate to the web 52 of the stud 50.

Figure 4:
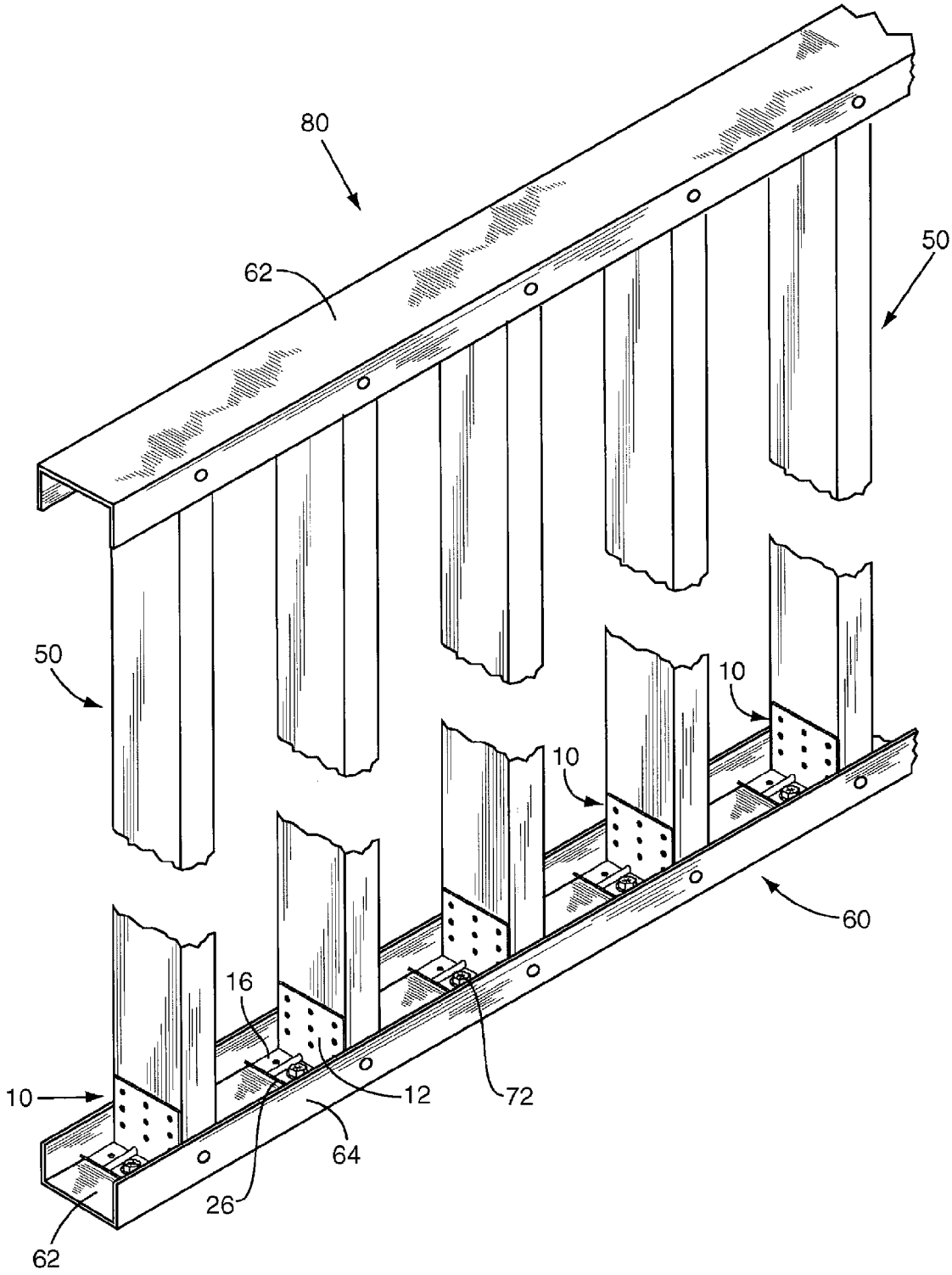
FIG. 4 is a perspective view of a wall section having connectors of the present invention incorporated therein.

Turning briefly to FIG. 4, there is shown therein a wall section indicated generally by the numeral 80. In this case, the wall section includes upper and lower channels 60 joined by a series of spaced apart studs 50. The connectors 10 of the present invention are specifically shown connecting the lower end portions of the studs 50 the lower channel 60. However, it is appreciated that the same connectors can be utilized by the upper portions of the studs 50 to connect the studs to the upper channel 60. Finally, both channels 60 would be disposed, in a typical application, adjacent a support structure such as a concrete floor, beam, etc. Therefore, the lag screw 72 extending through the base plate 16 of each connector would also extend into and connect to such an adjacent support structure.

The connector 10 of the present invention has numerous advantages. It is designed for strength and rigidity. In particular, it is designed to form a firm and rigid heavy duty connection between the opposed end portions of the studs 50 and any adjacent connected supporting structure.

The design of the connector including the ribs 18, the upturned flange 26 and the reinforcing member 28, enables the connector 10 to resist uplifting, horizontal and rotational loads that might be applied directly to or transferred to the connecting points where the studs 50 connect to the underlying or overlying channels and to the adjacent supporting structure.

Connector 10 may be constructed of various materials but it is contemplated that in one embodiment the connector would be constructed of metal. The embodiment illustrated herein is formed from a single metal piece by an appropriate stamping operation. Other fabrication methods could be used.

The thickness or gauge of the material utilized for the connector can vary to suit various types of applications.

With reference to FIGS. 5-11, the designs for a connector 200 are shown therein. In these embodiments, the connector 200 functions as a connector or support for connecting to a stud 300 in a wall structure. In addition, the same connector 200 can actually function as a stud in a wall structure, particularly a partial-wall structure that is discussed subsequently herein.

Figure 5:
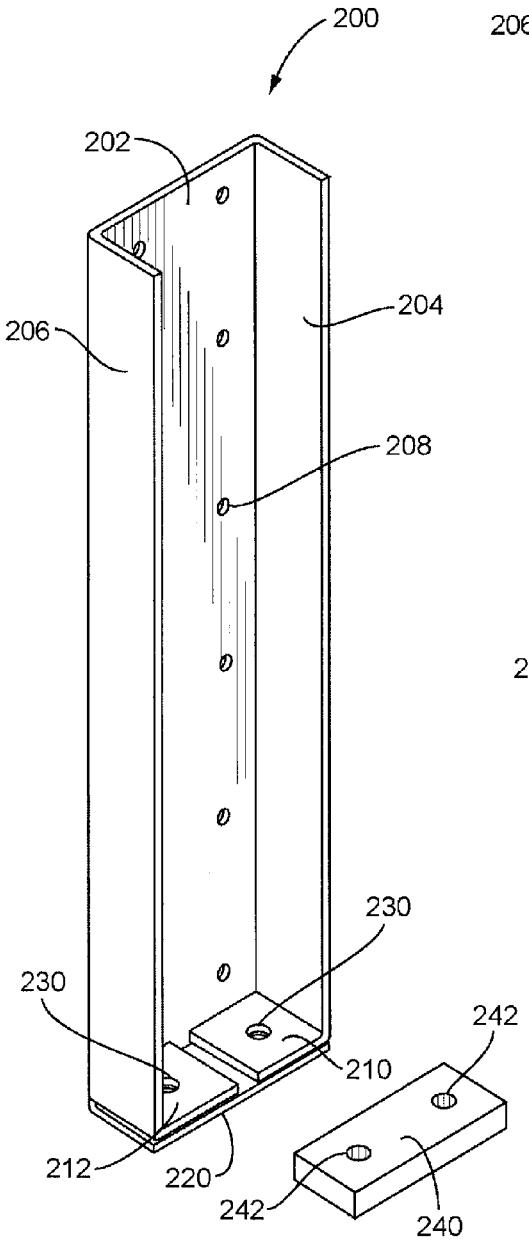
FIG. 5 is a perspective view of an alternate connector for connecting to a stud in a wall structure or functioning as a stud.

First, with respect to FIG. 5, there is shown therein a connector indicate generally by the numeral 200. As noted above, this connector 200 can function as a reinforcing structure for a stud in a wall structure as the same can be connected to the stud as well as to an underlying support structure. In addition, the same connector 200 can be utilized in a wall structure as a stud. In both cases, the connector 200 is typically used in what is generally referred to as a partial-wall or a half-wall.

Viewing the connector 200 shown in FIG. 5 in more detail, the same includes a web 202. Web 202 includes a front and a back. Extending from the web 202 is a pair of flanges, a first flange 204 and a second flange 206. With respect to the web 202, it is seen that the same includes a series of opening 208 that facilitate connecting web 202 to the web of a stud.

Disposed at the lower or bottom end portion of the connector 200 is a series of tabs, tabs 210, 212 and 220. Tab 210 is referred to as a first tab, tab 212 is referred to as a second tab, and tab 220 is referred to as a third tab. In the embodiment illustrated herein, the first tab 210 is an extension of first flange 204. That is, tab 210 is bent and extended from the first flange 204. The second tab 212 is an extension of the second flange 206. Again, the second tab 212 is bent about the lower end of the flange 206 and directed inwardly therefrom. The third tab on the other hand is an extension of the web 202. The third tab 220 is bent at an angle and extended underneath the first and second tabs 210 and 212. As seen in FIG. 5, tabs 210 and 212 are disposed generally in the same plane. Both tabs 210 and 212 include terminal ends that are slightly spaced apart as oriented in FIG. 5. Further, tab 210 is bent inwardly at an angle of approximately 90 degrees with respect to the first flange 204. Likewise, tab 212 is bent inwardly at an angle of approximately 90 degrees with respect to second flange 206. The third tab 220 underlies the first and second tabs 210 and 212 and is bent at an angle of approximately 90 degrees with respect to the web 202. This is illustrated in FIG. 5.

Tabs 210, 212 and 220 include openings 230 for permitting fasteners to be extended through the same. As seen in FIG. 5, each tab 210 and 212 includes one opening 230 in the underling third tab 220 includes two openings that are aligned with the openings 230 and the upper disposed tabs 210 and 212.

Figure 8:
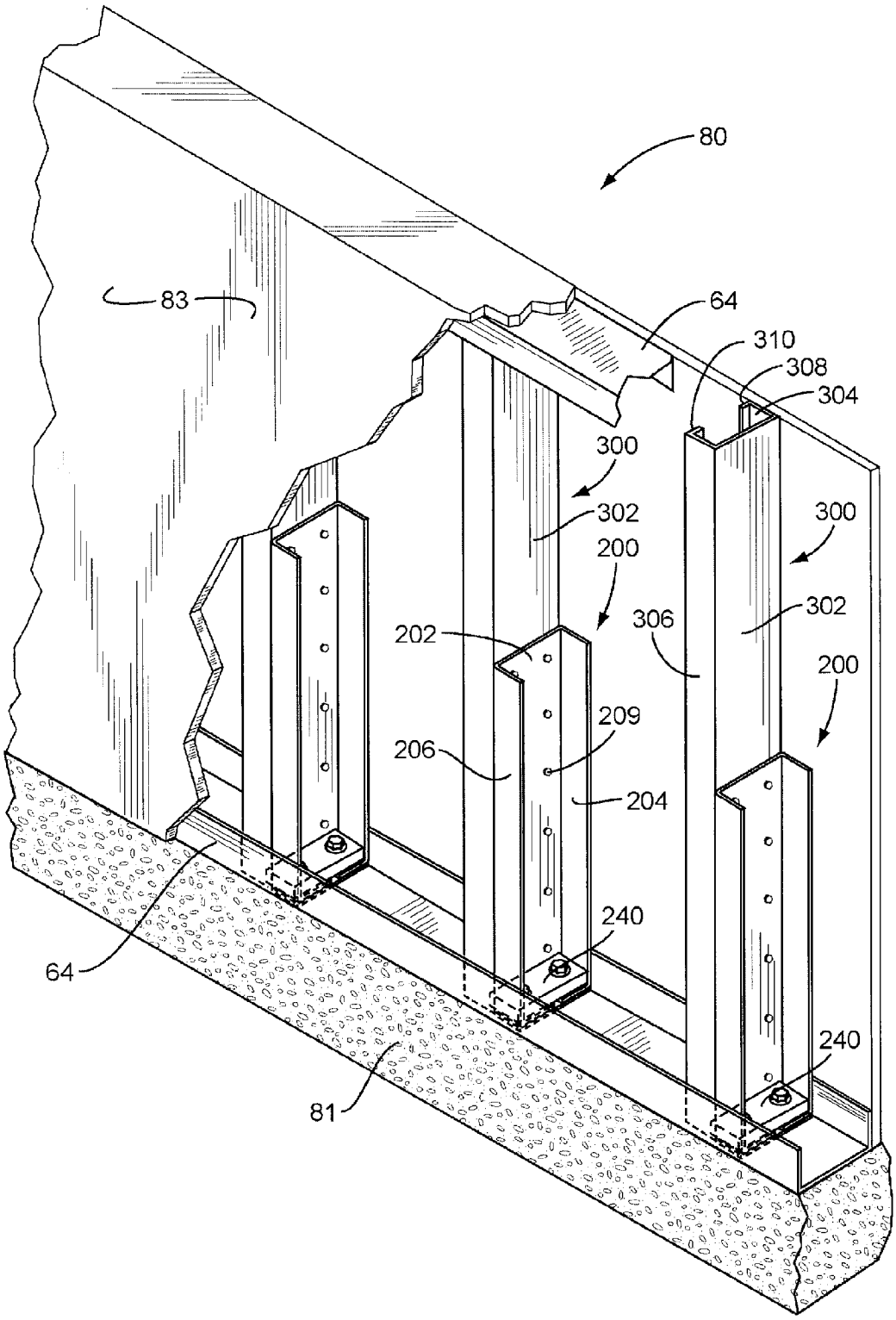
FIG. 8 is a perspective view of a partial wall with portions broken away to show the connector utilized in the wall structure.

As will be appreciated from subsequent portions of the disclosure, the lower end of the connector 200 is seated in a track, the lower track referred to by the numeral 64, as shown in FIG. 8. Fasteners are extended through the openings 230 into and through the track 64 and into an underlying floor or other support structure 81. When appropriately fastened, the upper tabs 210 and 212 are pressed into engagement with the underlying third tab 220.

In at least one embodiment, the lower structure of the connector 200 is reinforced by a reinforcing member such as plate 240. The reinforcing plate 240 includes a pair of openings 242. Reinforcing plate 240 is seated over the tabs 210 and 212 such that the openings 242 therein align with the openings 230 in tabs 210 and 212 as well as openings in the third tab 220. Fasteners are then extended through the reinforcing plate 240, the tabs 210 and 212, and the underlying third tab 220.

Figure 6:
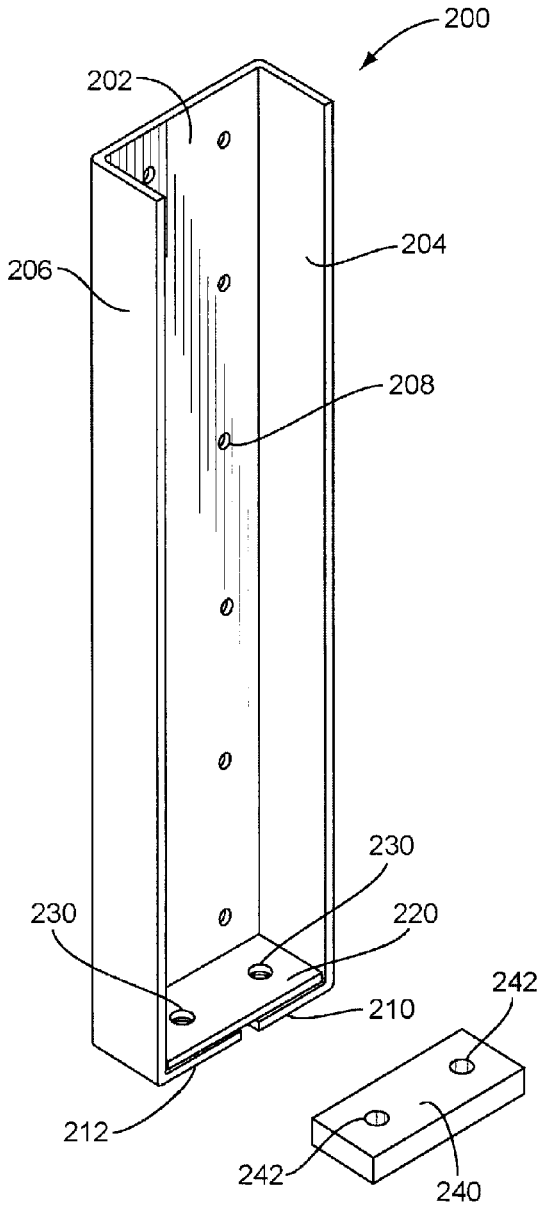
FIG. 6 is a perspective view of an alternate design for the connector shown in FIG. 5.

A slightly altered design for the connector 200 is shown in FIG. 6. Connector design shown in FIG. 6 is identical to that shown in FIG. 5 with the exception that the third tab 220 is disposed over the first and second tabs 210 and 212. The connector 200 shown in FIG. 6 functions the same as that described in connection with the FIG. 5 design.

Figure 7:
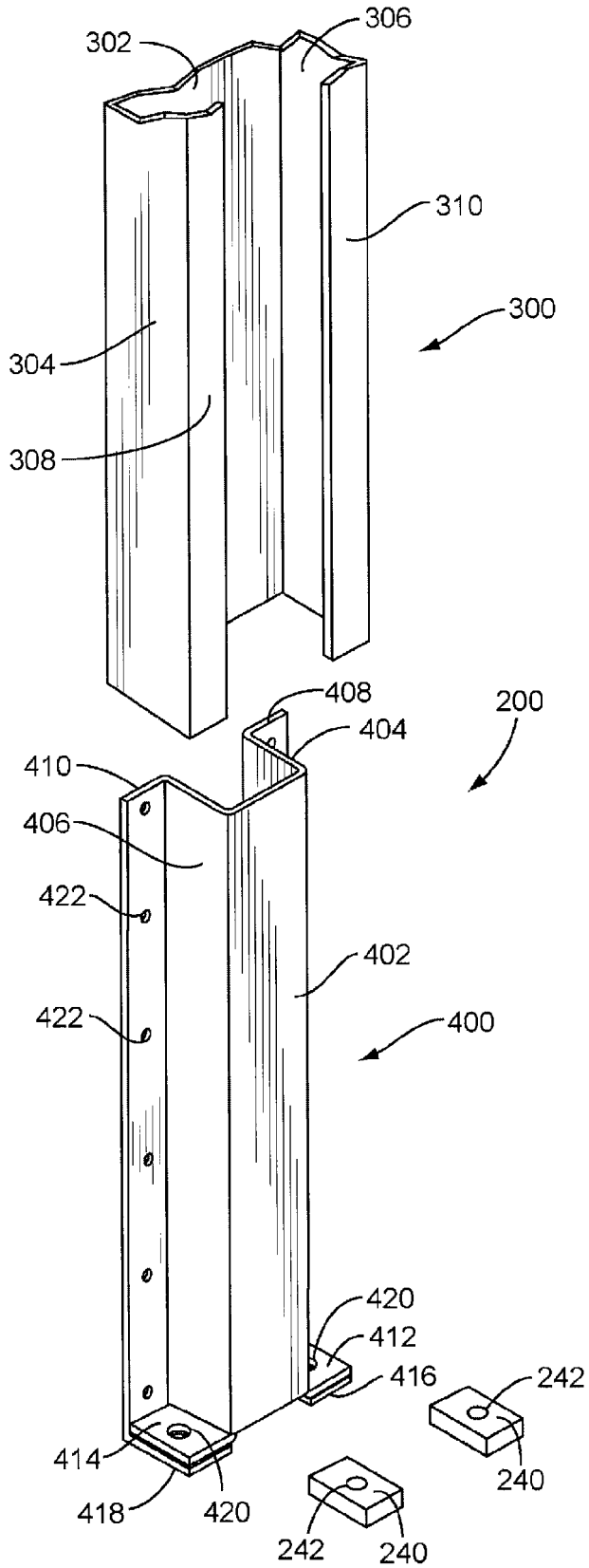
FIG. 7 is a perspective view of a connector of still another alternative design.

A third connector design is shown in FIG. 7. Here the connector is referred to generally by the numeral 200 is shown. Connector 200, shown in FIG. 7, includes an elongated channel indicated generally by the numeral 400. The elongated channel 400 includes an elongated web 402 and a pair of flanges, a first flange 404 and a second flange 406. Extending from the first and second flanges 404 and 406 are two other flanges that are referred to as a third flange 408 and a third flange 410. Note that in FIG. 7, the third flange 408 extends from the first flange 404. In addition, the fourth flange 410 extends from the second flange 406.

While the angles can vary, the first and second flanges 404 and 406 extend at an angle of approximately 90 degrees with respect to the web 402. Third and fourth flanges 408 and 410 extend at an angle of approximately 90 degrees with respect to the first and second flanges 404 and 406.

The connector 200 shown in FIG. 7 includes a series of tabs 412, 414, 416 and 418. These tabs are extensions of the various flanges 404, 406, 408 and 410 referred to above. More particularly, tab 412 extends from flange 404. Tab 414 extends from flange 406. Tab 416 extends from flange 408. Tab 418 extends from flange 410. Note that each tab 412, 414, 416 and 418 extends at an angle of approximately 90 degrees with respect to the flange from which it extends. Note that in this example, tabs 412 and 414 overlie tabs 416 and 418. It is appreciated that in an alternate design, that orientation could be reversed.

The tabs 412, 414, 416 and 418 include openings 420 for permitting a fastener to pass through the same. In addition, the flanges 408 and 410 include a series of spaced apart openings 422 for permitting a fastener to pass through these openings. As will be discussed later, the flanges 408 and 410 are designed to butt against the web of a stud such that the connector 200 can be secured to the web of the stove by extending fasteners through the openings 422 and through the web of the stud.

As discussed above, all of the connector designs discussed herein are designed such that the connector can be secured to a stud and function to reinforce the stud especially in the area where the stud connects to an underlying structure. In FIG. 8 of the drawings, there is shown a series of studs with each stud indicated generally by the numeral 300. The term "stud" as used herein means an upright post in the framework of a wall and specifically excludes structures that are not in a wall structure. Each stud includes a web 302 that includes a front and a back. A pair of flanges 304 and 306 project from the web 302. In addition, a pair of lips or returns 308 and 310 project from the flanges 304 and 306.

Turning to FIG. 8, there is shown therein a partial-wall indicated generally by the numeral 80. The connector shown in FIG. 5 is incorporated into this wall structure 80. In particular, the connector 200 is utilized to reinforce the studs 300 about the lower portion of the studs and particularly where the studs connect to the lower track 64 and the underlying floor or support 81.

Figure 9:
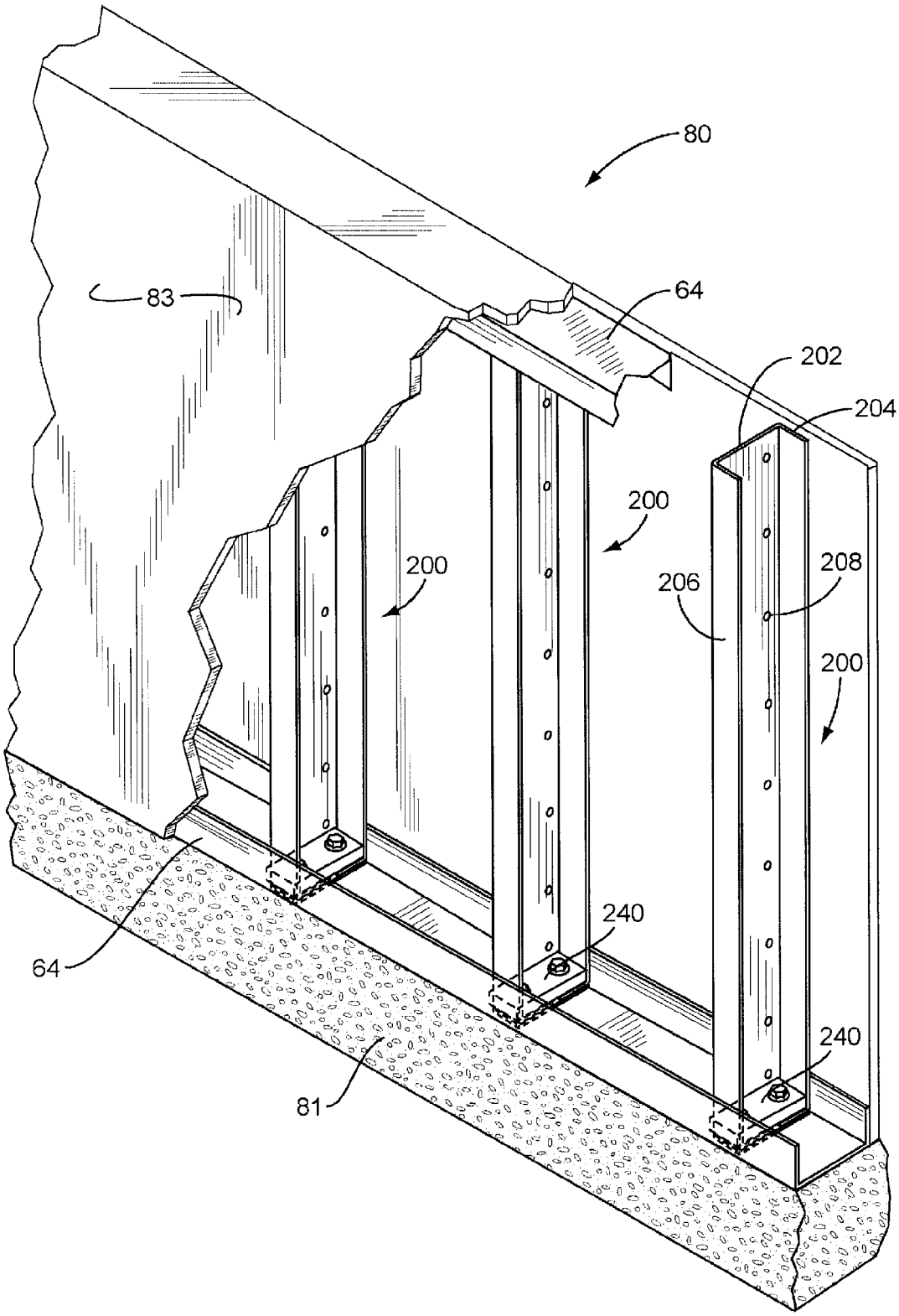
FIG. 9 is a perspective view similar to FIG. 8 but showing the connector functioning in the wall structure as a stud.

The wall structure 80 shown in FIGS. 8 and 9 is referred to as a partial-wall. Sometimes these wall structures are referred to as half-walls or knee-walls. The term "partial wall," "half-wall" or "knee wall" is specially defined herein. Each term means a wall that terminates substantially below a ceiling and is substantially unsupported at its top except for a metal track.

The length of the connectors shown in FIG. 8 can vary. In the examples shown, the partial-wall 80 is approximately 48 inches high and the connectors 200 are approximately 24 inches long. Note that the studs 300 and the connectors 200 are connected in back-to-back relationship. That is, the back of the web 202 of the connector 200 faces the back of the web 302 of each stud 300. Fasteners such as screws 209 and the like extend through opening 208 in the web 202 and securely fasten each connector 200 to an adjacent stud 300. The lower portion of each connector 200 is firmly anchored in the support 81. Fasteners such as screws or lag bolts are extended through the reinforcing member 240 and through the respective tabs 210, 212 and 220 so as to securely anchor the connectors 200 to the underlying support structure 81.

In the embodiment illustrated in FIG. 8, there is provided a connector 200 for each stud 300. In many applications, that may be unnecessary. In some applications, for example, only every other stud 300 would need or require connector 200. Thus, is it understood and appreciated that the connectors 200 could be selectively spaced in the wall structure 80.

As stated before, the connectors 200 may actually serve as studs. This is illustrated in FIG. 9. Here the connectors 200 are disposed in a partial wall 80. As noted above, the length of the connectors 200 can vary. In this case, the length of the connectors 200 is approximately 48 inches. The connectors are being used in a four foot partial-wall. Here the connectors are connected to the lower track 64 and the underlying support 81 in the same manner described with respect to the FIG. 8 design except that the connectors 200 stand alone and are not connected to adjacent studs.

Figure 10:
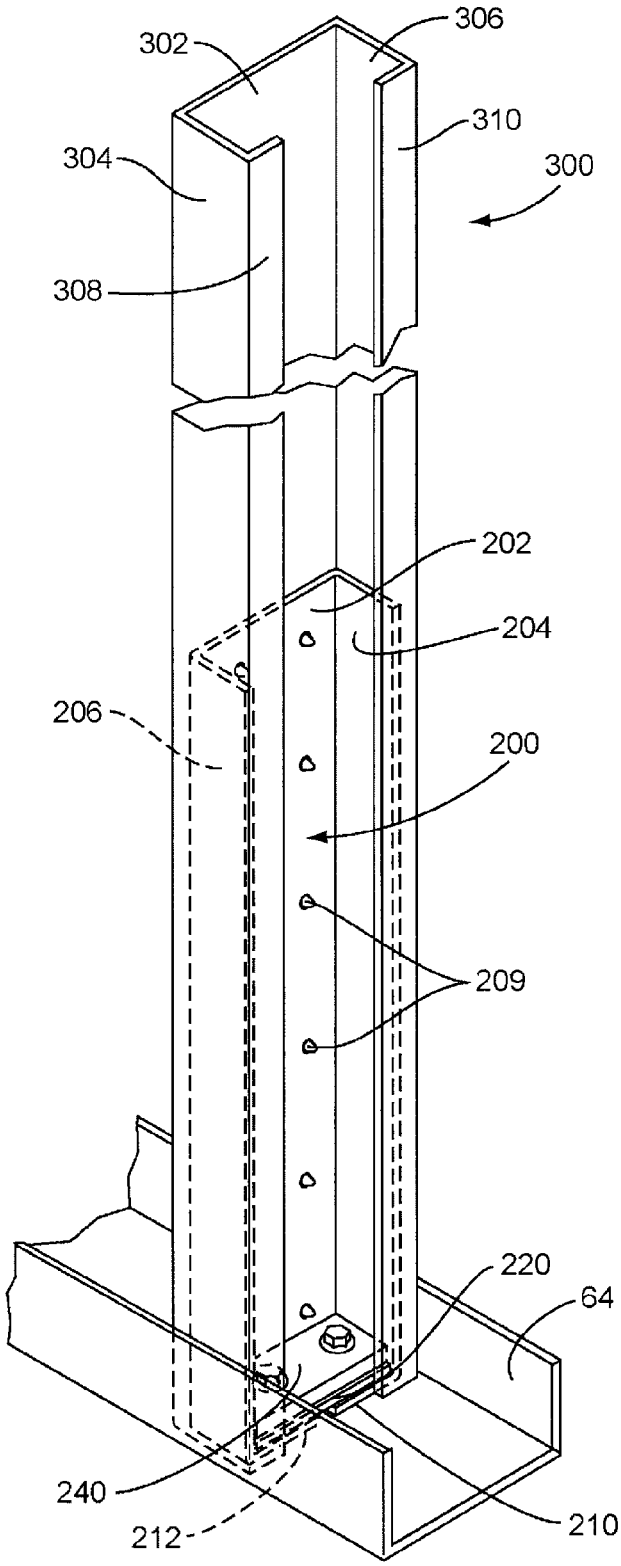
FIG. 10 is a perspective view illustrating how the connector shown in FIG. 6 can be connected to a stud.

FIG. 10 illustrates the connector shown in FIG. 6 being seated within a stud 300. This arrangement differs from the arrangement shown in FIG. 8. Here the actual connector 200 is generally confined within the interior of the stud 300. That is, the web 302, flanges 304 and 306 and the lips or returns 308 and 310 wrap around the connector 200. In this case the back of the web 202 faces the front of the web 302 of the stud. Again, fasteners are extended through openings 208 in the web 202 and basically interconnect the stud 300 to the connector 200. Thus the connector 200 can be seated or placed within the interior area of the stud 300 and utilized in a partial-wall 80.

Figure 11:
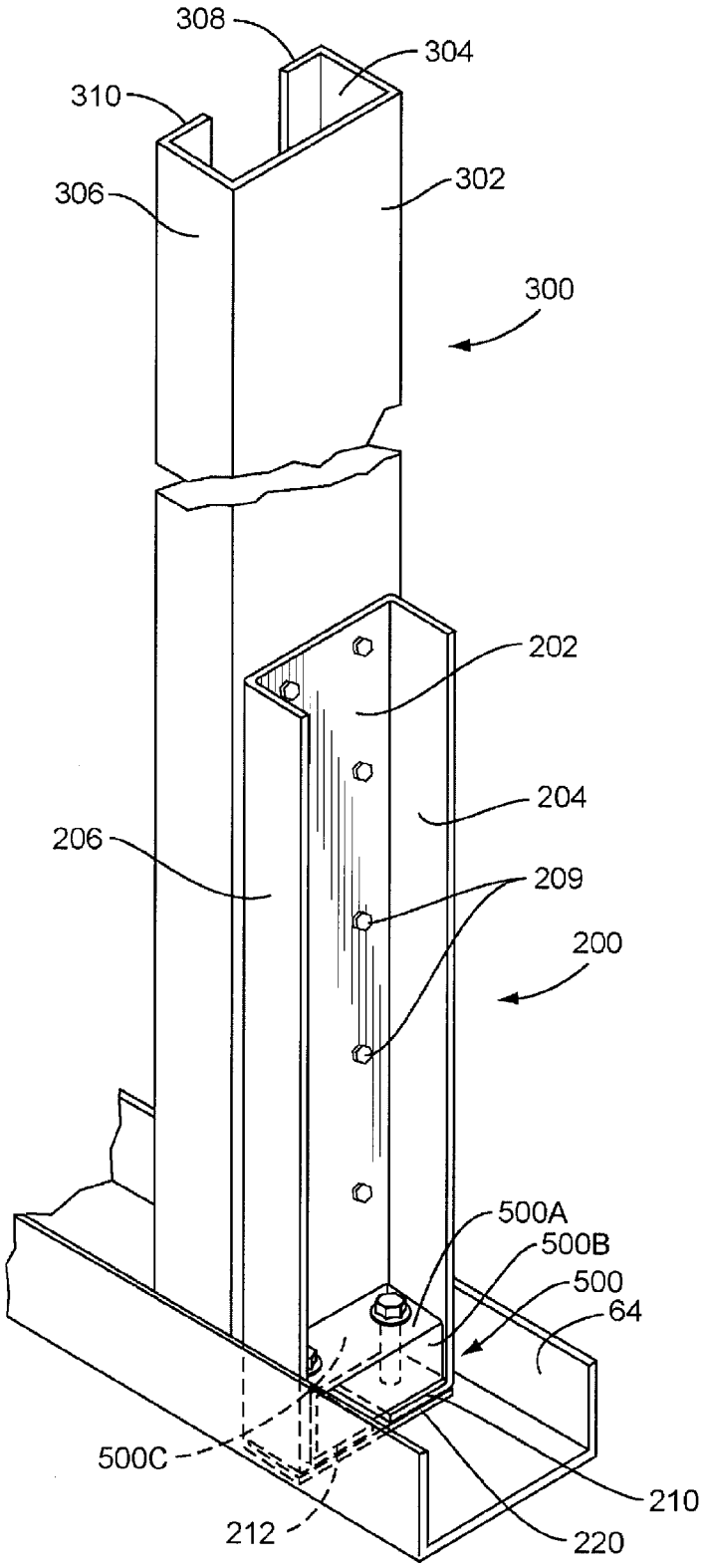
FIG. 11 in a perspective view showing the connector connected to a stud and further showing a reinforcing member in the form of an inverted channel disposed about the lower portion of the connector.

FIG. 11 illustrates a reinforcing channel, indicated generally by the numeral 500 that can be used in lieu of the reinforcing plate 240. Note that the reinforcing channel 500 forms an inverted U-shape and is placed over the tabs 210, 212 and 220 in the connector embodiments shown in FIGS. 5 and 6. The reinforcing channel 500 includes an upper section 500A and two downwardly depending legs 500B and 500C. The upper section 500A extends transversely across the connector 200 and the two legs 500B and 500C extend downwardly and are supported by tabs 210 and 212 in the case of the embodiment shown in FIG. 5 and tab 200 in the case of the embodiment shown in FIG. 6. The upper section 500 includes a pair of openings for receiving a pair of fasteners which extend through the upper section 500A and downwardly through the underlying tabs.

It is contemplated that the reinforcing channel 500 could be easily fabricated or constructed of ⅜ths inch steel. The dimension of such a reinforcing channel 500 could vary. In one embodiment it is contemplated that the reinforcing channel 500 would be approximately one inch high, approximately two inches deep, and have a width that permits the reinforcing channel to fit between the flanges 204 and 206 of the connectors shown in FIGS. 5 and 6. The use or application of the reinforcing channel 500 is shown in FIG. 11. It should be appreciated that the U-shaped channel 500 can be inverted from the position shown in FIG. 11. In an inverted position, the channel 500A assumes a U-shaped configuration. Here the section 500A lies flush against the tabs 210 and 212, and the legs 500B and 500C extend upwardly with one leg lying flush against the web 202 of the connector 200.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A knee wall structure including upper and lower tracks and including a connector assembly, wherein the connector assembly constitutes a stud and a plurality of the studs is provided in spaced apart relationship in the knee wall, and wherein the studs are connected between the upper and lower tracks, the connector assembly comprising: an elongated web having a length; first and second generally rectangular flanges extending from the web and disposed at an angle with respect to the web; each flange including a terminal longitudinal edge spaced away from the elongated web and extending parallel to the web, and each flange extending the full length of the web; first and second tabs disposed on one end of the connector; the first tab extending from an end portion of the first flange of the connector and the second tab extending from an end portion of the second flange of the connector; the first and second tabs being turned inwardly and at an angle with respect to the first and second flanges of the connector such that the first and second tabs lie in generally the same plane and wherein each of the first and second tabs includes a terminal end and wherein the terminal ends of the first and second tabs are disposed adjacent to each other; a third tab disposed on the end of the of the connector adjacent the first and second tabs; the third tab extending from an end of the web of the connector and turned at an angle with respect to the web; wherein the third tab extends over or under the first and second tabs such that the third tab lies closely adjacent the first and second tabs; the third tab being a planar tab and extending in a single plane; a reinforcing plate separate from the first, second and third tabs and positioned over the first, second and third tabs and confined in the connector assembly by the web and first and second flanges; and wherein the connector is configured to attach to a lower portion of a stud in the wall structure or to function as a stud in the wall structure.

2. The connector assembly of claim 1 wherein the third tab is disposed below the first and second tabs and wherein when the connector is secured within a wall the third tab engages the first and second tabs.

3. The connector assembly of claim 1 wherein:

the first tab forms an angle of approximately 90° with the first flange of the connector;

the second tab forms an angle of approximately 90° with the second flange of the connector; and wherein the third tab forms an angle of approximately 90° with the web of the connector.

4. The connector assembly of claim 3 wherein:

the first tab is an extension of the first flange of the connector;

the second tab is an extension of the second flange of the connector; and the third tab is an extension of the web of the connector.

5. The connector assembly of claim 1 wherein the reinforcing plate includes one or more openings.

* * * * *